US006269053B1

(12) United States Patent
Kawata et al.

(10) Patent No.: US 6,269,053 B1
(45) Date of Patent: Jul. 31, 2001

(54) SMALL-SIZED ELECTRONIC APPLIANCE WITH A SENSOR

(75) Inventors: Masayuki Kawata; Eriko Noguchi, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/542,564

(22) Filed: Apr. 4, 2000

(30) Foreign Application Priority Data

Jun. 4, 1999 (JP) ..... 11-098733

(51) Int. Cl.[7] ..... G04B 47/00; G04B 37/00
(52) U.S. Cl. ..... 368/10; 368/88
(58) Field of Search ..... 368/10, 11, 88, 368/276, 278, 294–296

(56) References Cited

U.S. PATENT DOCUMENTS 4,787,072 * 11/1988 Jou ..... 368/76
5,481,506 * 1/1996 Kita ..... 368/10
5,781,511 * 7/1998 Yasukawa et al. ..... 368/11

* cited by examiner

*Primary Examiner*—Vit Miska
(74) *Attorney, Agent, or Firm*—Adams & Wilks

(57) ABSTRACT

A metal-made coil spring is accommodated in a conduction hole of a spacer. A metal-made pin passes through a circuit support base, circuit board and spacer. A connection board is placed on a conduction hole of the spacer and fixed by a holding plate and a metal-made fixing screw. The coil spring has a height set greater than a thickness of the spacer. If the connection board is attached by the fixing screw, the coil spring is brought into a compressed state by the action of the holding plate and circuit board. Due to this, because the coil spring is strongly urged onto the circuit board and connection board, electric conduction is provided from the sensor unit to the circuit board.

10 Claims, 7 Drawing Sheets

SMALL-SIZED ELECTRONIC APPLIANCE WITH A SENSOR

BACKGROUND OF THE INVENTION

1. Field of the Invention

This invention relates to a small-sized electronic appliance that the connection can be stabilized from a sensor unit to a circuit board.

2. Description of the Prior Art

FIG. 6 is a partial sectional view showing an electronic timepiece with a sensor disclosed in Japanese Patent Laid-open No. 339294/1992. In this electronic timepiece with a sensor 500, a circuit board 502 is provided on a housing 501 made of a synthetic resin. On this circuit board 502 a flexible connection board 503 is provided, and this connection board 503 is connected to a sensor unit (not shown). Meanwhile, the connection board 503 is urged onto the circuit board 502 by a support member 504. The support member 504 is fixed on the housing 501 by a screw 505, a thread portion of which is screwed to a clip 506 provided in the housing 501. Also, a spacer 507 of an elastic member is provided between the support member 504 and the connection board 503. The spacer 507 has a projection 571 formed in an underside, and this projection 571 is to be abutted against the connection board 503. An electronic part 508, such as a temperature compensation resistance, is attached on the connection board 503 in the support member 504. In this electronic timepiece with a sensor 500, the connection board 503 is urged onto the circuit board 502 by an elastic force obtained due to tightening of the spacer 507 and screw 505, thereby securing electrical conduction.

In the conventional electronic timepiece with a sensor 500, however, because screw fixing is made to the synthetic resin-made housing 501, the screw 505 readily loosen due to deformation by thermal expansion or external stresses. Also, there is a fear that the urging force of the connection board 503 and circuit board 502 weakens due to deterioration in the spacer 507. Due to this, there has been a problem that a contact state worsens between the connection board 503 and the circuit board 502. In particular, such problem has a great affection for a small-sized electronic appliance because a current to be used is slight.

Besides this, the examples for connecting the sensor unit and circuit board include a wrist watch with a sensor disclosed in Japanese Patent Laid-open No. 270551/1995. FIG. 7 is a partial sectional view showing this wrist watch with a sensor. This wrist watch with a sensor 600 provides direct electrical conduction between the sensor unit 601 and the circuit board 602 without using a flexible connection board. The sensor unit 601 is attached to a case 603 and supported by a sensor retaining part 604. The sensor unit 601 is electrically connected through the circuit board 602 provided on a backside of a panel frame 605 and a connector 606. A cell 608 is accommodated in a space between the circuit board 602 and a back lid 607.

However, in this wrist watch with a sensor 600 there is a restriction in design concerning the sensor position in comparison to the above electronic timepiece with a sensor 500 in that no flexible connection board is used. Furthermore, because the principal object is not in an improvement of a connection state of the circuit board 602 and sensor unit 601, devising seems to be not made in the relevant portion (around connector). Due to this, there is a possibility that poor contact occur between the circuit board 602 and the connector 606 during manufacture, cell exchange or the like.

Therefore, this invention has been made in view of the above and its object is to provide a small-sized electronic appliance with a sensor that an electric connection can be stabilized from a sensor unit to a circuit board.

SUMMARY OF THE INVENTION

In order to achieve the above object, the space is regulated between the circuit board and the connection board in which spacing a conductive elastic member is arranged in a pressurized state, whereby positive contact is given to the circuit board and connection board thereby fully coping with change in the space. Specifically, the spacing between the circuit board and the connection board is regulated by a spacer, and a conductive elastic member is inserted in a conduction hole provided in this spacer. The circuit board and the connection board are fixed to the spacer by a fixing member to make the conductive elastic member into a pressurized state. However, the invention is not limited to this structure. The conductive elastic member preferably uses connector rubber having a conductive spring or conductive material.

Also, by structuring the fixing member by a metal-made male screw or female screw, it is strengthened to thermal expansion. The fixed member is correspondingly prevented from being loosened. Furthermore, it is effective to provide rotation prevention means to this screw. Incidentally, this structure is applicable to electronic timepieces, portable measuring instruments, portable telephone, game machine or other small-sized electronic appliances with a sensor.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
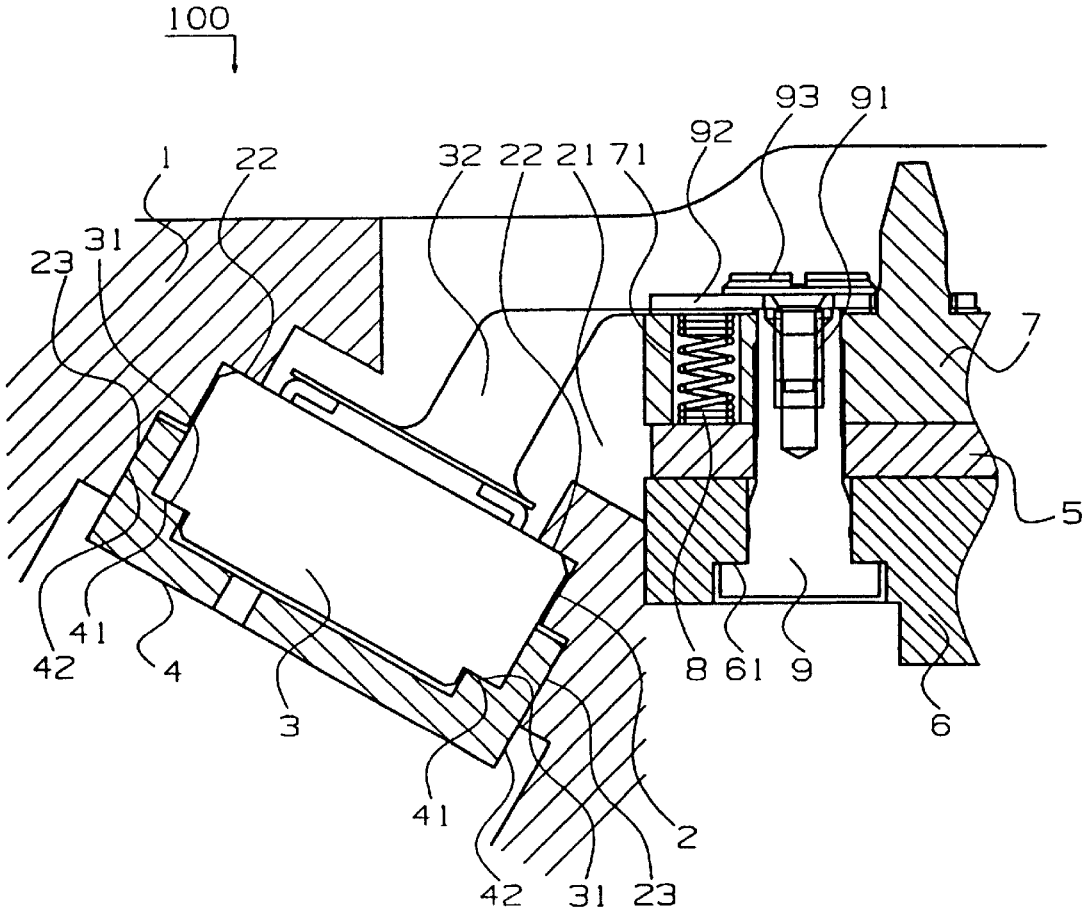
FIG. 1 is a fragmentary sectional view showing an electronic timepiece with a sensor according to Embodiment 1 of this invention.

Hereunder, this invention will be explained in detail while referring to the drawings. Incidentally, this invention is not limited by the embodiments.

Embodiment 1

FIG. 1 is a fragmentary sectional view showing an electronic timepiece with a sensor according to Embodiment 1 of this invention. This electronic timepiece with a sensor 100 is a timepiece having, for example, a pressure sensor for detecting water pressure or air pressure, a temperature sensor for detecting external temperature, a magnetic sensor for detecting magnetism, an optical sensor for detecting light, and so on. An appliance case 1 is formed therein with a sensor unit accommodating section 2 at an inside of which are formed a communication 21 to a timepiece module and a step 22 fixing a mount depth of a sensor unit 3. The sensor unit 3 is fitted in the sensor accommodation section 2 at a front of which a retaining cover 4 is attached.

The retaining cover 4 and the sensor unit accommodating portion 2 are in close fit. By pressing the retaining cover 4 against the sensor unit accommodating portion 2, the sensor unit 3 can be fixed to the appliance case 1. In the retaining case 4 is formed a step 41 abutting against a front face of the sensor unit 3. Sealing is made inside the appliance case 1 by a seal member (not shown) provided on this step 41, a peripheral edge 31 of the sensor unit 3 and between an outer peripheral surface 42 of the retaining case and an inner peripheral surface 23 of the sensor unit accommodating portion 2. Meanwhile, a flexible connection board 32 of the sensor unit 3 is guided to an inside of the appliance case 1 through the communication 21.

A circuit board 5 of the timepiece module is mounted at its one surface on a circuit support base 6, and at another surface to a spacer 7 as a cell frame. This spacer 7 at an end is formed with a conduction hole 71 in which a conduction metal-made compression coil spring 8 is accommodated. On the other hand, the circuit support base 6, circuit board 5 and spacer 7 are passed through by a metal-made pin 9 in a timepiece thickness direction. A head of it engages a seat 61 of the circuit support base 6. Also, the pin 9 has a foot cut with a female thread 91. The above-described connection board 32 is rested on the conduction hole 71 of the spacer 7, and fixed by a push plate 92 and metal-make fixing screw 93. The coil spring 8 has a height set greater than a thickness of the spacer 7. If the connection board 32 is attached by a fixing screw 93, the coil spring 8 becomes a compression state by the action of the push plate 92 and circuit board 5. Due to this, the coil spring 8 is strongly urged against both the circuit board 5 and the connection board 32. Because at a contact portion with the coil spring 8 a predetermined electrode (not shown) is formed together with the circuit board 5 and connection board 32, electrical conduction is available from the sensor unit 3 to the circuit board 5 by the above-described coil spring 8. With this structure, even if a spacing between the push plate 92 and the circuit board 5 by any of stress or the like, the coil spring 8 follows up and deforms, securing conduction at all times.

Figure 2:
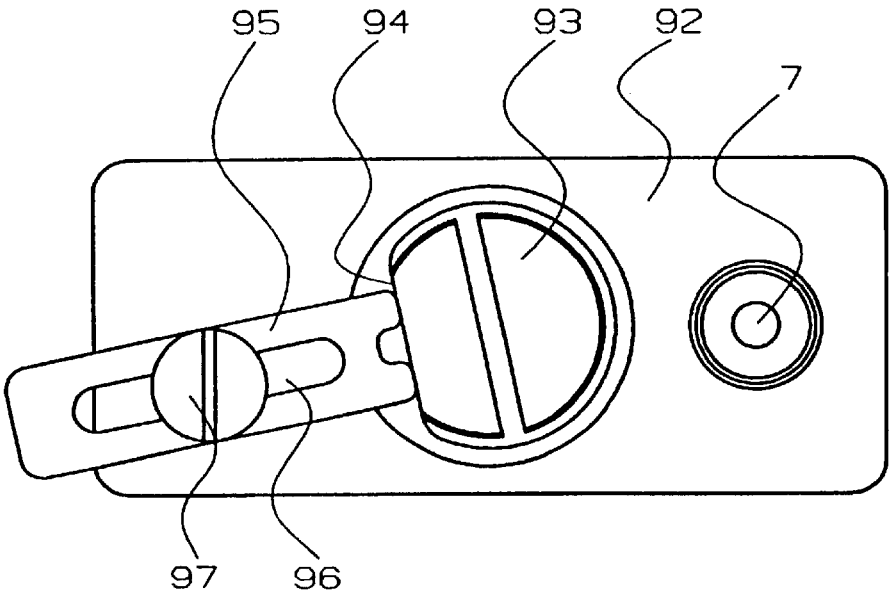
FIG. 2 is a plan view showing a rotation prevention portion.

Meanwhile, as shown in FIG. 2, the fixing screw 93 is provided at a head with a cut-out 94. This cut-out 94 is abutted against by a rotation prevention part 95. The rotation prevention part 95 has an elongate hole 96 to have a structure that it is adjusted in position through the elongate hole 96 and fixed by a screw 97. Furthermore, because the pin 9 and fixing screw 93 are metal-make, the fixing screw 93 can be effectively prevented from being loosened. Incidentally, the rotation prevention part 95 is not limited to the structure shown in FIG. 2 but can be fixed using, for example, a split pin. Or otherwise, the cut-out can be made in a semi-circular form so that a head of a bolt for rotation prevention is fit in the cut-out (not shown).

Figure 3:
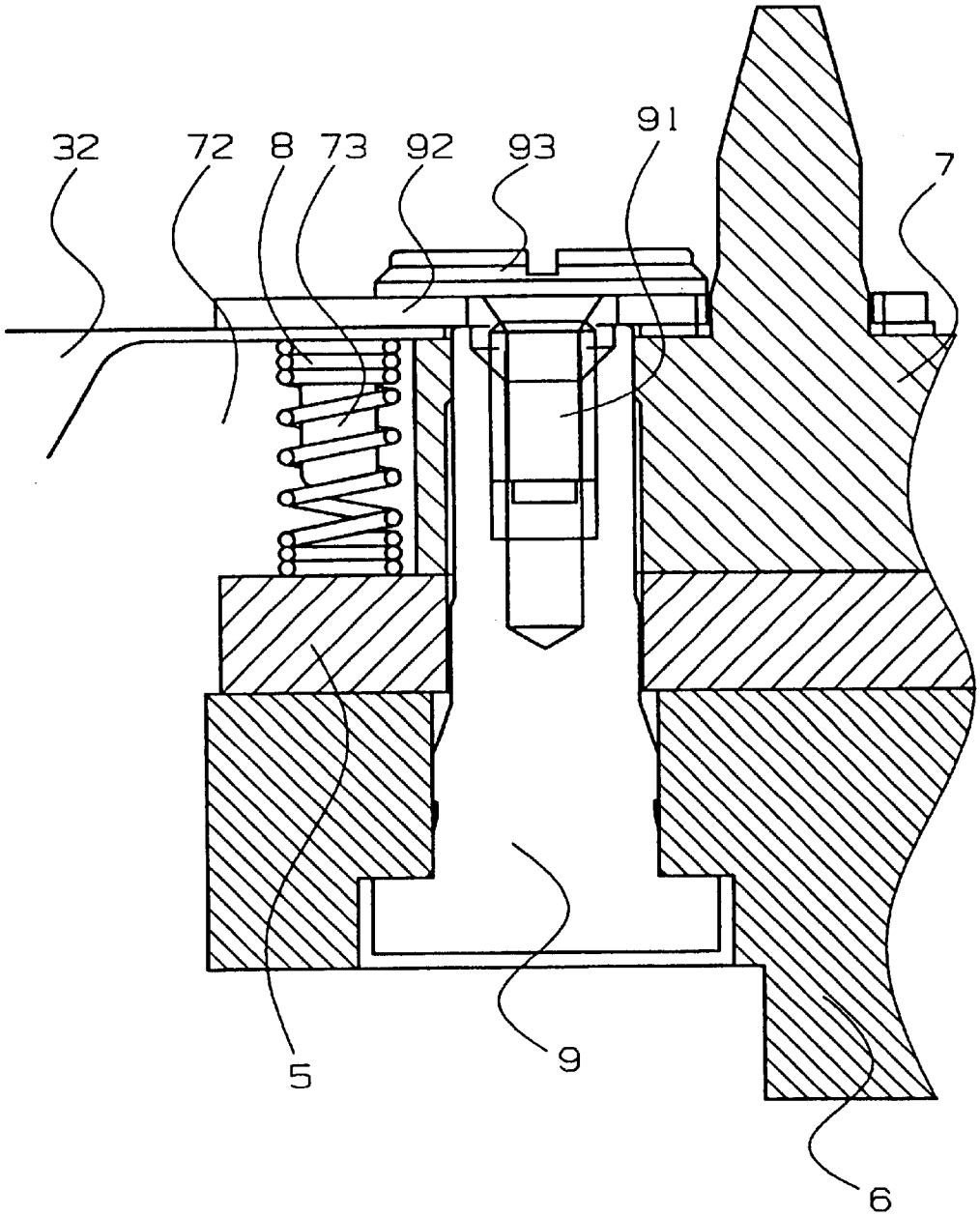
FIG. 3 is a fragmentary sectional view showing a modification of the electronic timepiece with a sensor.
Figure 4:
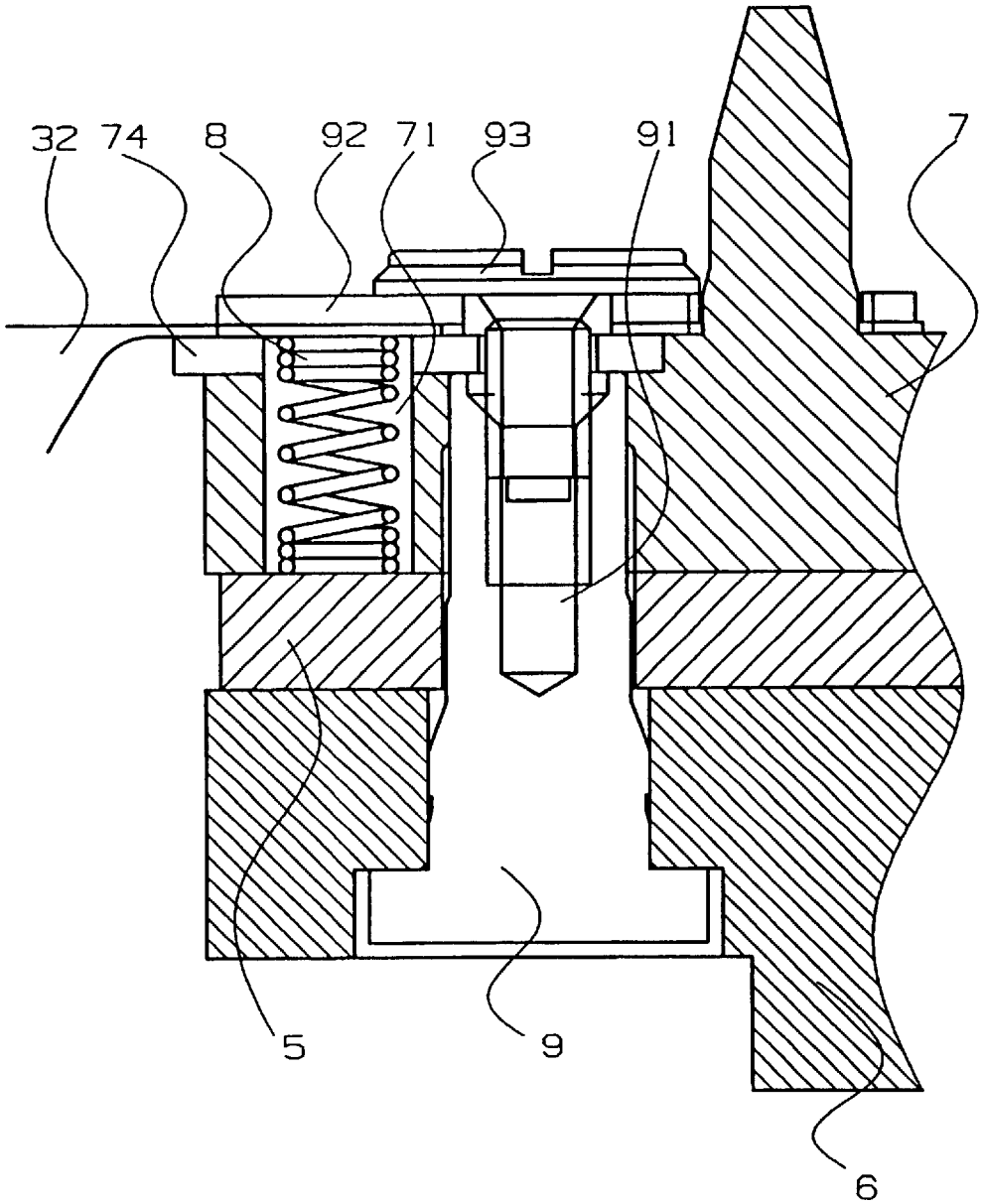
FIG. 4 is a fragmentary sectional view showing a modification of the electronic timepiece with a sensor.

Next, although in the above the conduction hole 71 of the spacer 7 was used to regulate a position of the coil spring 8, the invention is not limited to this provided that capable of regulate the coil spring 8 position. For example, as shown in FIG. 3 the coil spring may be regulated by a guide rod 73 projecting from the push plate 92 or circuit board 5 in the cut-out 72 of the spacer 7. Also, there is no limitation to the spacer 7 in regulating the spacing between the circuit board 5 and the connection board 32. For, example, as shown in FIG. 4 a pressurization adjusting spacer 74 may be inserted between the spacer 7 and the push plate 92 to adjust a pressurizing force of the coil spring 8. Incidentally, this; structure may be applied to a multi-hand analog quartz or digital quartz.

Embodiment 2

Figure 5:
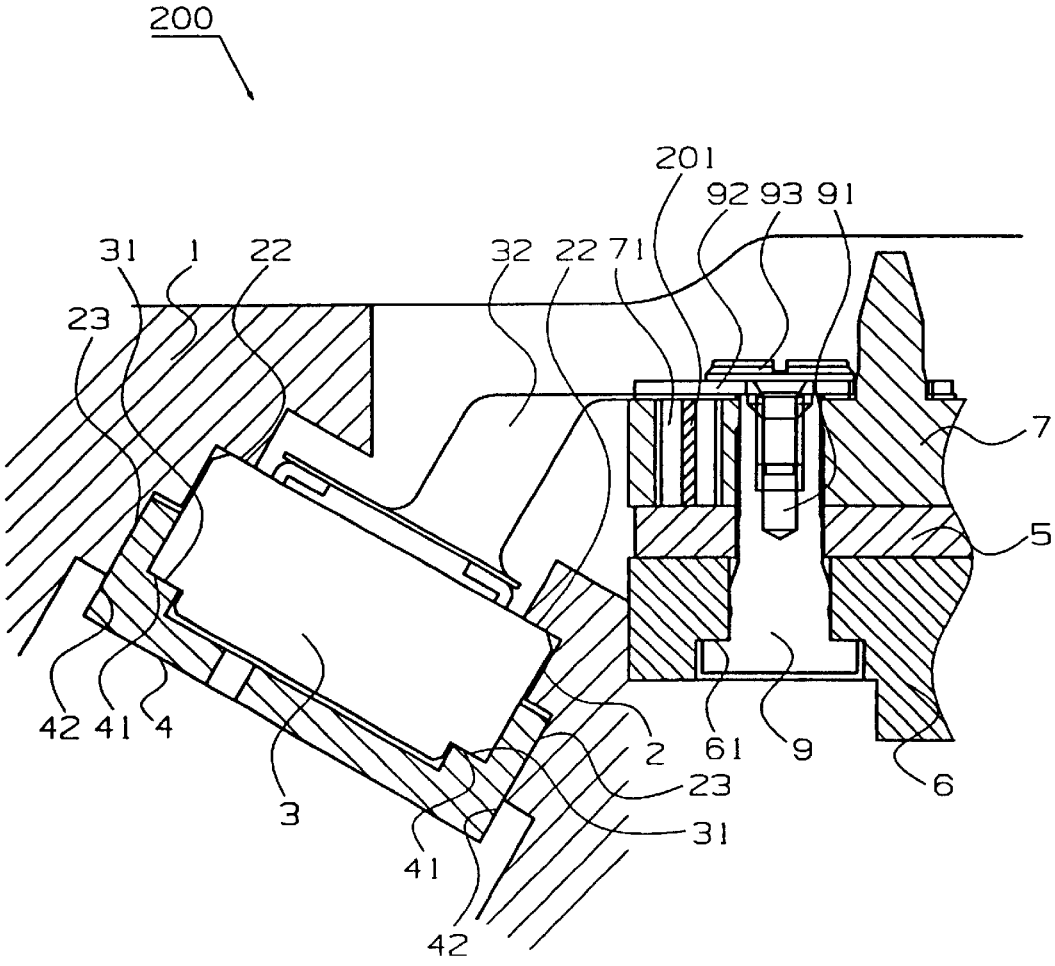
FIG. 5 is a fragmentary sectional view showing an electronic timepiece with a sensor according to Embodiment 2 of this invention.
Figure 6:
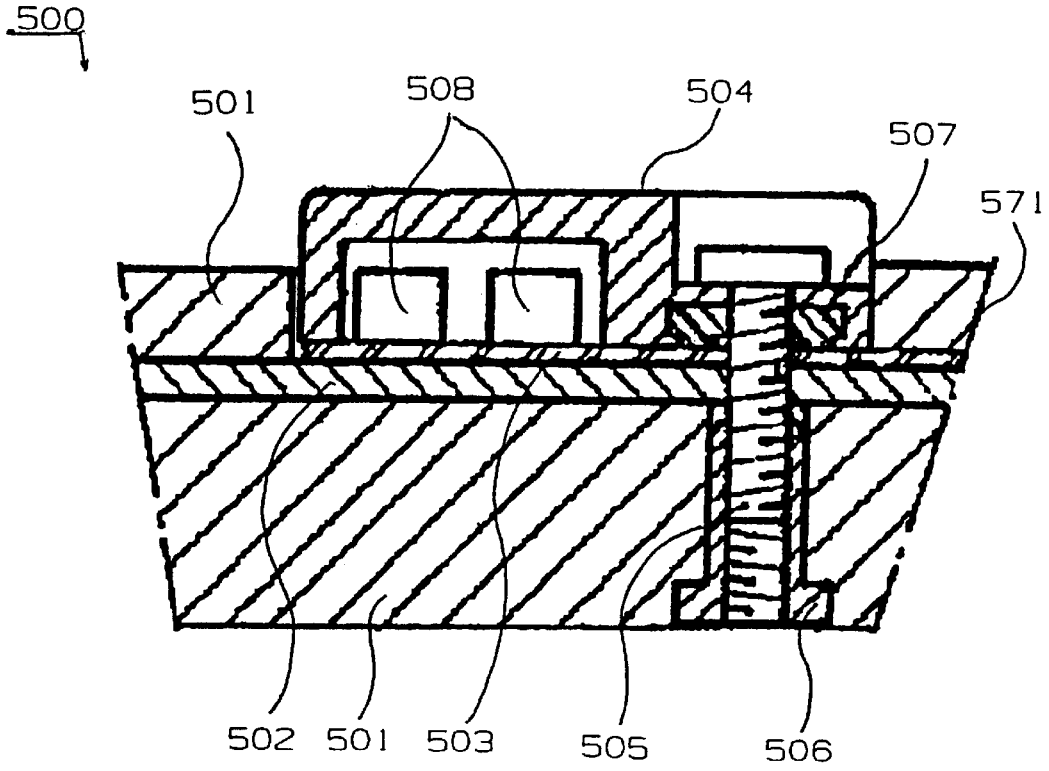
FIG. 6 Prior Art
FIG. 6 is a fragmentary sectional view showing an electronic timepiece with a sensor disclosed in Japanese Patent Laid-open No. 339294/1992.
Figure 7:
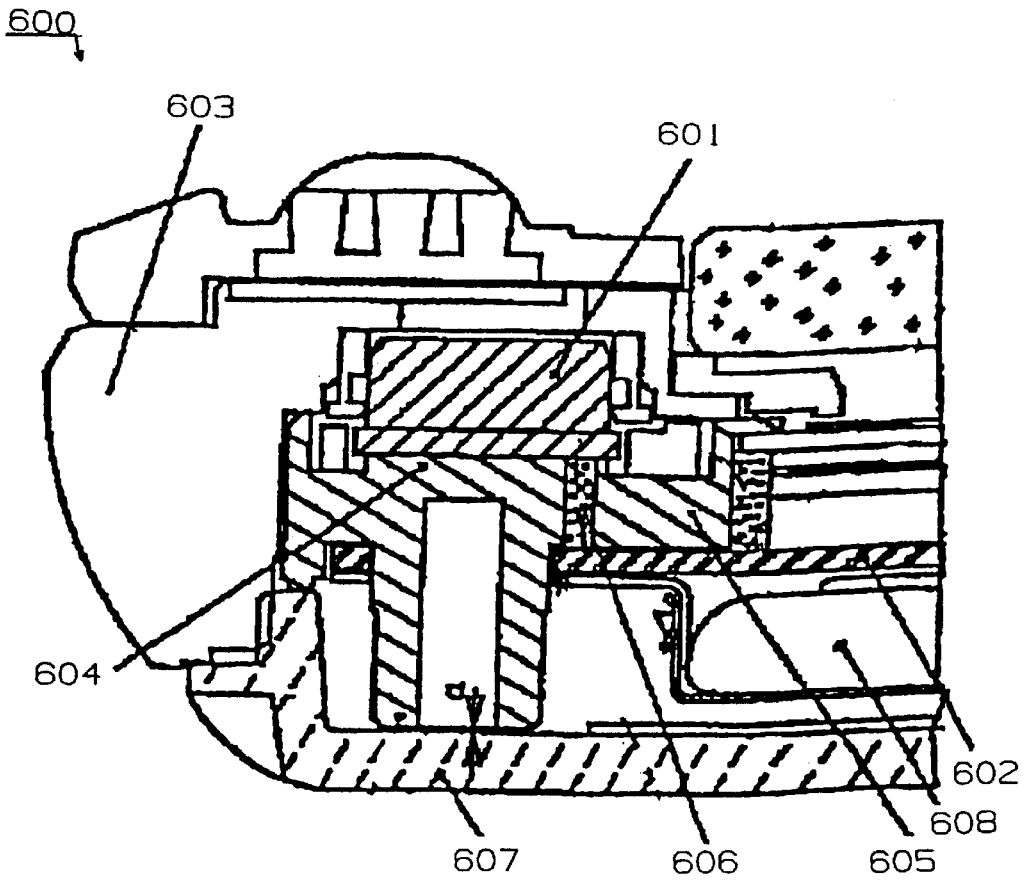
FIG. 7 Prior Art
FIG. 7 is a fragmentary sectional view showing an electronic timepiece with a sensor disclosed in Japanese Patent Laid-open No. 270551/1995.

FIG. 5 is a fragmentary sectional view showing a timepiece with a sensor according to Embodiment 2 of the invention. The electronic timepiece with a sensor 200 is characterized in that a connector rubber with gold wires 201 is used as a conduction elastic member. Other structures are similar to the electronic timepiece with a sensor 100 of Embodiment 1, and explanations thereof are omitted herein. This electronic timepiece with a sensor 200 uses a connector rubber 201 with gold wire in the conduction hole 71 of the spacer 7. The connector rubber 201 can be urged onto both the circuit board 92 and the connection board 32 because it is in a compression state due to the circuit board 5 and press plate 92. Due to this, electrical conduction is given from the sensor unit 3 to the circuit board 5.

Incidentally, the above-described connector rubber 201 is not limited to the one with gold wire but may be a silver wire or copper wire provided that it is of a material to conduct electricity. However, because to handle a slight current, the connector rubber 201 preferably uses one low in electric resistance. Also, the rubber member may be formed around with a conductor (not shown). Also, even where the invention is applied to a small-sized electronic appliance, a similar structure is satisfactory to the above-described Embodiment 1 and 2.

As explained above, according to the small-sized electronic appliance with a sensor of the invention, because the conductive elastic member in a pressurized state is arranged between the circuit board and the connection board, it is possible to stabilize the electrical conduction of from the sensor unit to the circuit board.

What is claimed is:

1. An electronic timepiece with a sensor comprising:

a circuit board mounted with an electronic circuit;

an apparatus case accommodating the circuit board;

a sensor unit mounted on the apparatus case;

a connection board extending from the sensor unit;

a regulating member for regulating a spacing between the circuit board and the connection board; and a conductive elastic member arranged in a pressurized state between the circuit board and the connection board to provide conduction between the circuit board and the connection board.

2. An electronic timepiece with a sensor comprising:

a circuit board mounted with an electronic circuit;

an apparatus case accommodating the circuit board;

a sensor unit mounted on the apparatus case;

a connection board extending from the sensor unit;

a spacer arranged between the circuit board and the connection board and having a conduction hole to communicate between the circuit board and the connection board;

a conductive elastic member inserted in the conduction hole and formed of an elastic member to provide conduction between the circuit board and the connection board;

a fixing member for fixing the circuit board and the connection board to the spacer and making the conductive elastic member in a pressurized state between the circuit board and the connection board.

3. An electronic timepiece with a sensor according to claim 1, characterized in that said conductive elastic member is connector rubber having therein a conductive spring or a conductive material.

4. An electronic timepiece with a sensor according to claim 2, characterized in that said conductive elastic member is connector rubber having therein a conductive spring or a conductive material.

5. An electronic timepiece with a sensor according to claim 1, characterized in that further said fixing member is a metal-made male and female screws.

6. An electronic timepiece with a sensor according to claim 2, characterized in that further said fixing member is a metal-made male and female screws.

7. An electronic timepiece with a sensor according to claim 3, characterized in that further said fixing member is a metal-made male and female screws.

8. An electronic timepiece with a sensor according to claim 5, characterized in that further said screws are provided with rotation prevention means.

9. An electronic timepiece with a sensor according to claim 6, characterized in that further said screws are provided with rotation prevention means.

10. An electronic timepiece with a sensor according to claim 7, characterized in that further said screws are provided with rotation prevention means.

* * * * *